United States Patent [19]

Shih

[11] 4,452,690

[45] Jun. 5, 1984

[54] PETROLEUM RESIDUAL VISBREAKING THROUGH MOLECULAR GRAFTING

[75] Inventor: Stuart S. Shih, Cherry Hill, N.J.

[73] Assignee: Mobil Oil Corporation, New York, N.Y.

[21] Appl. No.: 390,102

[22] Filed: Jun. 21, 1982

[51] Int. Cl.[3] ..... C10G 31/00

[52] U.S. Cl. ..... 208/46; 208/44; 585/446; 585/721; 585/732; 204/162 HE

[58] Field of Search ..... 208/46, 44; 585/721, 585/732, 446; 204/162 HE

[56] References Cited

U.S. PATENT DOCUMENTS

| | | | |
|---|---|---|---|
| 2,277,938 | 3/1942 | Subkow | 208/46 |
| 2,378,762 | 6/1945 | Frey | 208/46 |
| 3,051,766 | 8/1962 | Hunter et al. | 585/446 |
| 3,547,850 | 12/1970 | Montgomery | 208/44 |
| 3,763,270 | 10/1973 | Schmerling | 585/721 |
| 3,773,843 | 11/1973 | Schmerling | 585/721 |
| 4,033,852 | 7/1977 | Horowitz et al. | 208/8 LE |
| 4,191,799 | 3/1980 | Gruber | 585/732 |
| 4,298,455 | 11/1981 | Huang | 208/48 AA |

FOREIGN PATENT DOCUMENTS

| | | | |
|---|---|---|---|
| 516378 | 9/1955 | Canada | 585/721 |
| 876963 | 9/1961 | United Kingdom | 585/446 |

*Primary Examiner*—Delbert E. Gantz
*Assistant Examiner*—Cynthia A. Prezlock
*Attorney, Agent, or Firm*—Alexander J. McKillop; Michael G. Gilman; Richard D. Stone

[57] ABSTRACT

Chemical methods for diminishing the viscosity of petroleum residuals are disclosed. According to a preferred embodiment, residuals and olefins are coreacted employing a peroxide and a silver salt at a temperature between the pour point of the residual and about 350° C.

12 Claims, No Drawings

PETROLEUM RESIDUAL VISBREAKING THROUGH MOLECULAR GRAFTING

BACKGROUND OF THE INVENTION

This invention is directed to methods for the improvement of petroleum residual materials. More particularly, means for the reduction of viscosity in residual petroleum fractions are disclosed which employ the grafting of olefins thereto.

The production of hydrocarbons from petroleum feedstocks generally results in the concomitant production of residuals. A residual in the present context is that portion of a petroleum feedstock which remains as a bottoms product after the distillation or removal of low and moderate boiling hydrocarbon fractions therefrom. Those skilled in the art will understand that such residuals are composed of complex pluralities of generally large hydrocarbon molecules, most of which are aromatic in character. Residuals are known to be extremely viscous; their economic utility is limited in part by this viscosity. Accordingly, methods for the reduction of viscosity in petroleum residuals are desired.

Heretofor, viscosity reduction in petroleum residuals has been accomplished through thermal visbreaking. Thus, residual petroleum fractions have been heated to temperatures upwards of 350° C. for a period of time on the order of about 10 minutes. This heat treatment causes thermal "cracking" to occur. Such cracking, which is believed to comprise a diminution in the molecular weight of individual molecules comprising components of the residual, leads to a reduction in viscosity due to a reduction in component molecular weight. Thermal visbreaking has several serious shortcomings however. Accordingly, it known that the heating of residuals for too long a time or at too high a temperature results in their becoming incompatible with other petroleum species to the end that blending into useful hydrocarbon blends is rendered difficult. While the exact mechanism of the effect is not presently understood, it is known that stringently heat treated residuals will form sediment when blended with the lighter petroleum feedstocks; such sedimentation is highly undesirable.

At the same time, thermal visbreaking is expensive in terms of energy requirements; processes involving lower temperatures are to be desired. Accordingly, it has long been desired to provide methods for the lowering of viscosity of residuals, which methods may be undertaken at lower temperatures and which are not likely to lead to the formation of products prone to sedimentation.

It has been known to graft olefinic moieties onto coal in an attempt to improve liquifaction characteristics of coal. See in this regard; "Development of Clean, 'Liquid' Coal Advanced," Combustion, Vol. 48 (10), pp. 34–37 (1977); U.S. Pat. No. 4,033,852-Horowitz et. al.; and U.S. Pat. No. 4,263,123-Ebert et. al. The improvement of petroleum residuals through chemical visbreaking in accordance with the present invention has not, however, been disclosed or suggested.

OBJECTS OF THE INVENTION

It is an object of this invention to provide methods for the improvement of petroleum residuals by lowering their viscosity.

It is a further object to lower the viscosity of petroleum residuals through graft polymerization of olefinic materials thereto.

A further object is to provide visbroken petroleum residuals which are less prone to sedimentation than are their thermally visbroken counterparts.

Yet another object is to provide means for the graft copolymerization of aliphatic olefins with petroleum residuals.

These and other objects will become apparent from a review of the present specification and claims.

SUMMARY OF THE INVENTION

The present invention provides a method for the improvement of petroleum residuals comprising reacting the residual with an olefin. According to a preferred embodiment, a free radical catalyzed graft polymerization of an olefin, preferably an aliphatic olefin, onto the chemical components of a petroleum residual material is accomplished whereby the viscosity of the reacted material is substantially diminished. Provision of a free radical generating species together with a silver salt is preferred for effecting this result.

DETAILED DESCRIPTION OF THE INVENTION

The processes of the present invention improve petroleum residuals by chemically lowering their viscosity. It is known that petroleum residuals comprise a high proportion of aromatic species having a wide range of proportions and identities. The viscosity of a particular petroleum residual has been determined largely to be attributable to three factors, molecular weight, hydrogen bonding, and $\pi$-$\pi$ interactions among aromatic nuclei. It is well known that, in general, materials having relatively high molecular weights will possess large viscosities, boiling points, and other intensive properties than will similar materials having lower molecular weights. This well recognized factor has been exploited by the prior art practice of thermal visbreaking as discussed hereinabove. The present invention accomplishes the diminution of viscosity of petroleum residuals through disruption of hydrogen bonding and $\pi$-$\pi$ interactions among the molecules of the residuals. Thus, by alkylating the residual in accordance with the present invention, substantial steric interference with attainment of most energetically favorable geometric arrangements of molecules within the residual is obtained. Accordingly, it is believed that the spatial orientation of aromatic nuclei of the molecules of the residual composition inter se could not be adopted having the most favorable stereoelectronic interaction; $\pi$-$\pi$ bonding is believed to be interfered with. Similarly, the orientation of molecules such that hydrogen bonding among suitably donative and receptive functional groups of the molecules comprising petroleum residuals is also disrupted. It is believed that as a result of alkylation the most energetically favorable geometric arrangement of molecules in a petroleum residual cannot be attained; a lessening of viscosity results.

While some increase in overall molecular weight will be obtained through the alkylation reactions in accordance with the present invention, and while such increase would generally be expected to increase the viscosity of the residual thus treated, surprisingly, such adverse effects appear to be far overshadowed by the benefits to be obtained through steric disruption as discussed hereinabove. Decreases in viscosity of petroleum residuals after alkylation with olefins in accordance with the present invention have been observed.

The free radical alkylation of olefins onto substrates is well known. See U.S. Pat. No. 3,698,931-Horowitz wherein such grafting is disclosed in connection with a number of substrates. It is similarly well known to employ free radical generating species such as peroxides together with metallic salts such as silver salts to facilitate such alkylation.

A wide variety of olefinic species may be employed in the practice of the present invention. Thus, both straight chain and branched alkenes may be employed. It is additionally possible to employ aralkyl species such as styrene, methyl styrene and others in the practice of this invention. It is preferred to employ olefins which are substantially aliphatic and comprise a primary or secondary material having from about 2 to about 20 carbon atoms therein. Preferred species include normal alkenes such as 1-octene, 1-decene, 1-dodecene, etc. Propene, butene, isobutene, and numerous other species are also suitable. Mixtures such as $C_3$–$C_4$ olefins and $C_5$–$C_6$ naphtha together with the product of coking units and other mixtures are also suitable and may be preferred in some cases.

In accordance with the practice of the present invention, a petroleum residual is mixed with an olefin and allowed to coreact therewith. According to preferred embodiments of the present invention, reaction takes place at an elevated temperature. More particularly, temperatures in excess of the pour point of the residual are preferred. Such elevated temperatures facilitate the proper mixing of olefin and residual and aid in the initiation of the alkylation reaction. While such reactions may take place within a wide range of temperatures, it is desired to keep the reaction temperature at a minimum consistent with good mixing, processing characteristics, and conditions of polymerization initiation. In general, however the reaction will take place at a temperature above the pour point of the residual but less than about 350° C. It is preferred that the reaction take place at a temperature between about 75° C. and about 250° C.

The grafting or alkylation reaction between olefin and residual material is thought to proceed through a free radical polymerization mechanism. Accordingly, it is preferred to include an effective amount of a free radical generating species to facilitate reaction. Those skilled in art will appreciate that a wide variety of such free radical generating species are known; any of these may be employed in the practice of this invention. Peroxides such as t-butyl peroxide, benzoyl peroxide, diisobutyl peroxide, dicumyl peroxide, etc. may be employed and are preferred. It is also possible to initiate the alkylation-grafting reaction through exposure of the residual-olefin mixture to ionizing radiation.

A metallic cocatalyst is preferably also employed in the practice of the present invention when free radical generating species are used. Thus, a metallic salt, especially a silver salt, may be so employed. Accordingly, combinations of peroxides and silver salts are preferably employed in the promotion of the alkylation reactions in accordance with the present invention. Amounts of peroxide and silver salt which are effective in the promotion of the reaction are preferred; excesses may also be employed but are not preferred due to ecomonic considerations.

The alkylation-grafting reaction is allowed to proceed for a period of time sufficient to cause substantial polymerization of olefin with the residual material to result in the diminution of viscosity. In general, reaction times of from about 1 hour to about 3 hours have been found to be sufficient for substantial reaction of olefin with the residual material.

It has been found that the employment of excess olefin during the practice of the processes of the present invention tends to militate against rapid, efficient uptake of olefin into the residual. In general, therefore, it is desirable not to employ large excesses of olefin in the present processes. Large amounts of peroxide or silver, however, do not have the foregoing effect and may be employed if desired. It is necessary to react the petroleum residual with an amount of olefin sufficient to cause a reduction in viscosity of the residual. It has been found that the reacting of sufficient olefin with residual to result in a weight gain based on the weight of the residual of from about 2% to about 6% results in a substantial decrease in the viscosity of the residual when 1-octene or 1-dodecene is employed as the olefin. Those skilled in the art may easily determine optimum olefin uptake for any particular residual material and for any particular olefin mixture to be employed.

EXAMPLES

A 4-neck mixing flask equipped with a stirrer, condenser and thermometer were charged with 300 grams of Arab Heavy vacuum residual material having the properties indicated in Table 1. Amounts of t-butyl peroxide and olefin, either 1-octene, 1-dodecene, or methyl stryene in accordance with the information provided for Examples 1–24 of Table 2 were added to the flask together with 0.1 weight percent of silver nitrate. The temperature was raised to 93° C. and the mixture stirred for three hours. The reaction mixture could, optionally, be quenched through the addition of a small amount of water.

The reacted mixture was then distilled at atmospheric pressure to either 177° C. or 260° C. to recover unreacted olefin and any degradation products. The weight gain (or loss as indicated by an asterisk in Table 2) was measured and the conversion of olefin to bottoms product was subsequently calculated. The data are presented in Table 2.

With regard to the experiments performed with 1-octene, a general correlation between viscosity reduction and percent weight gain of olefin grafted residual may be drawn. A maximum reduction of 74% in viscosity from 3987 to 1031 cs at 100° C. was seen to occur at a 4.5% weight gain. Measurements of residual bottoms product distilled at 260° C. are more equivocal than those at 177° C. and indicate a lack of correlation between viscosity reduction and weight gain under those conditions. In addition, the observed viscosity reductions were smaller and may indicate at least a partial degradation of product distilled at this higher temperature.

The conversion of olefin to grafted product appars to be inversely related to olefin percentage; high conversion appears to occur at lesser olefin loadings. It may be speculated that olefin inhibition of the free radical process may account for this effect. Increasing peroxide concentrations tend to increase conversion of olefin to grafted product.

While methyl styrene appears to have a relatively low reactivity in the practice of this invention, efficacy is nonetheless shown.

TABLE 1

| Arabian Heavy Vacuum Resid | |
|---|---|
| API Gravity | 6.4 |
| Hydrogen | 10.12 wt. % |
| Nitrogen | 0.43 wt. % |
| Sulfur | 5.37 wt. % |
| Aromatics | 98 wt. % |
| KV, @ 100 C | 3987 c.s. |
| Asphaltenes | 23.15 wt. % |
| CCR | 19.84 wt. % |
| Point | 49° C. |
| DISTILLATION PROFILE | |
| Initial B.P. | 452° C. |
| 5 pct, wt. | 506° C. |
| 10 pct, wt. | 533° C. |
| 20 pct, wt. | 574° C. |

TABLE 2

| Example | Olefin | Olefin wt. % | Peroxide wt. % | wt. gain % | Olefin conversion wt. % | Kinetic viscosity at 100° C. c.s. After Distillation at 177° C. (350° F.) | Kinetic viscosity at 100° C. c.s. After Distillation at 260° C. (500° F.) |
|---|---|---|---|---|---|---|---|
| — | None | — | — | — | — | 3987 | 4782 |
| 1 | 1-Octene | 5 | 0.30 | * | * | | 4886 |
| 2 | " | 10 | 0.00 | * | * | 4776 | |
| 3 | " | 10 | 0.03 | 2.24 | 22.40 | 3312 | |
| 4 | " | 10 | 0.30 | 5.21 | 52.10 | — | — |
| 5 | " | 10 | 5.00 | 9.42 | 94.20 | | 4446 |
| 6 | " | 20 | 0.03 | 0.87 | 4.00 | 4232 | |
| 7 | " | 20 | 0.30 | 3.02 | 15.10 | 1199 | |
| 8 | " | 20 | 5.00 | * | * | | 5115 |
| 9 | " | 30 | 0.00 | 2.03 | 6.70 | 4132 | |
| 10 | " | 30 | 0.03 | 4.53 | 15.10 | 1031 | |
| 11 | " | 30 | 0.30 | 1.64 | 5.50 | 2294 | |
| 12 | " | 30 | 5.00 | 6.42 | 21.40 | | 4494 |
| 13 | " | 40 | 0.30 | 4.91 | 12.30 | | 4985 |
| 14 | 1-dodecene | 10 | 0.03 | 4.06 | 40.60 | | 3099 |
| 15 | " | 10 | 0.30 | 1.17 | 11.70 | | 2501 |
| 16 | " | 10 | 5.00 | 4.42 | 44.20 | | 5993 |
| 17 | " | 20 | 0.03 | * | * | | 4023 |
| 18 | " | 20 | 0.30 | 3.14 | 15.7 | | 3514 |
| 19 | " | 20 | 5.00 | 5.86 | 29.30 | | 3638 |
| 20 | " | 30 | 0.03 | 2.24 | 7.47 | | 4643 |
| 21 | " | 30 | 0.30 | 3.44 | 11.50 | | 4314 |
| 22 | " | 30 | 5.00 | 3.85 | 12.8 | | 3318 |
| 23 | methyl- | 10 | 5.00 | * | * | | 3767 |
| 24 | styrene | 30 | 5.00 | 2.03 | 6.70 | | 2357 |

What is claimed:

1. A method for improving the properties of a petroleum residual comprising reacting said residual at a temperature above the pour point of said residual but below 350° C. with added olefin in the presence of a catalyst comprising a free radical generating species.

2. The method of claim 1 wherein said catalyst also contains a metal salt.

3. The method of claim 2 wherein said free radical generating species is ionizing radiation or an organic peroxide.

4. The method of claim 3 wherein said organic peroxide is selected from the group consisting of t-butyl peroxide, benzoyl peroxide, diisobutyl peroxide and dicumyl peroxide.

5. The method of claim 2 wherein said metal salt is a silver salt.

6. The method of claim 1 wherein said olefin is a primary or secondary aliphatic olefin containing 2 to 20 carbon atoms.

7. The method of claim 6 wherein the olefin is selected from the group consisting of propene, butene, isobutene, 1-octene, 1-decene and 1-dodecene.

8. The method of claim 1 wherein the temperature is from about 75° C. to about 250° C.

9. The method of claim 1 wherein sufficient olefin is reacted to result in a weight gain based on the weight of the residual of from about 2% to about 6%.

10. The method of claim 2 wherein the residual is a heavy vacuum residual, the olefin is 1-octene, the catalyst is t-butyl peroxide and the silver salt is silver nitrate.

11. The method of claim 2 wherein the residual is a heavy vacuum residual, the olefin is 1-dodecene, the catalyst is t-butyl peroxide and the silver salt is silver nitrate.

12. The method of claim 2 wherein the residual is a heavy vacuum residual, the olefin is methyl styrene, the catalyst is t-butyl peroxide and the silver salt is silver nitrate.

* * * * *